US008056537B2

(12) United States Patent
Venkataraghavan et al.

(10) Patent No.: US 8,056,537 B2
(45) Date of Patent: Nov. 15, 2011

(54) ENGINE HAVING FUEL INJECTOR WITH ACTUATOR COOLING SYSTEM AND METHOD

(75) Inventors: Jayaraman K. Venkataraghavan, Dunlap, IL (US); Michael C. Long, Metamora, IL (US); Shriprasad Lakhapati, Peoria, IL (US); Stephen R. Lewis, Chillicothe, IL (US); Amy M. Hess, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 630 days.

(21) Appl. No.: 12/286,005

(22) Filed: Sep. 26, 2008

(65) Prior Publication Data

US 2010/0077971 A1 Apr. 1, 2010

(51) Int. Cl.
*F02M 69/46* (2006.01)

(52) U.S. Cl. ..... 123/456; 239/132; 239/124

(58) Field of Classification Search ..... 123/541, 123/456; 239/132, 124, 89
See application file for complete search history.

(56) References Cited

U.S. PATENT DOCUMENTS

| | | | | |
|---|---|---|---|---|
| 3,737,100 | A * | 6/1973 | Dreisin | 239/89 |
| 4,553,059 | A | 11/1985 | Abe et al. | |
| 6,390,069 | B1 | 5/2002 | Jiang et al. | |
| 6,424,078 | B1 * | 7/2002 | Heinz | 310/328 |
| 7,021,558 | B2 * | 4/2006 | Chenanda et al. | 239/125 |
| 2006/0279173 | A1 | 12/2006 | Kimura et al. | |
| 2009/0236441 | A1 * | 9/2009 | Hess et al. | 239/102.2 |
| 2009/0302130 | A1 * | 12/2009 | Venkataraghavan et al. | 239/132 |

* cited by examiner

*Primary Examiner* — Michael Cuff
*Assistant Examiner* — James Kim
(74) *Attorney, Agent, or Firm* — Liell & McNeil

(57) ABSTRACT

An internal combustion engine, such as a direct injection compression ignition diesel engine, includes an engine housing having a plurality of cylinders and a plurality of fuel injectors associated one with each of the cylinders. The fuel injectors each include a first fuel inlet and a second fuel inlet, and an actuator subassembly which is configured to actuate a control valve assembly positioned within the fuel injector. The engine further includes a fuel system having a fuel supply circuit, and a cooling system for the actuator subassembly having a cooling circuit with a segment in common with a segment of the fuel system. The cooling system is configured to pass cooling fuel across a heat exchange interface of the actuator subassembly to exchange heat therewith. The actuator subassembly may include a piezoelectric actuator and a preloading spring, which are each fluidly sealed within a casing of the actuator subassembly.

19 Claims, 4 Drawing Sheets

ENGINE HAVING FUEL INJECTOR WITH ACTUATOR COOLING SYSTEM AND METHOD

TECHNICAL FIELD

The present disclosure relates generally to fuel injected internal combustion engines, and relates more particularly to cooling an actuator for a fuel injector by way of passing cooling fuel through a body of the fuel injector and across a heat exchange interface of the actuator.

BACKGROUND

Many components of internal combustion engine systems are subjected to relatively high temperatures during operation. In some instances, without some dedicated means for cooling engine system components, operation of the engine system may be sub-optimal, or even compromised altogether. Certain fuel system components commonly used in internal combustion engines are one notable example where cooling may be desired. It is common for fuel injectors used in internal combustion engines to utilize relatively fast moving control valves, actuators and the like to control fuel injection into an associated engine cylinder. The relatively rapid actuation of electrical actuators commonly used in fuel injectors can generate heat, which in combination with heat generated by the engine itself, can raise the temperature of the actuator and associated components above desired levels.

In recent years, piezoelectric actuators have been increasingly used to actuate fuel injector components. Piezoelectric actuators typically consist of a piezoelectric element which changes conformation, typically by lengthening in response to application of an electrical potential. Conventional systems employ a piezoelectric actuator which relatively rapidly lengthens and shortens to control the position of a control valve, which is in turn responsible for controlling a timing of fuel injection. As a piezoelectric element cycles between an excited state and an unexcited state, it tends to generate a relatively large amount of heat. Where piezoelectric actuators are used, problems attendant to cooling may be particularly acute.

U.S. Pat. No. 4,553,059 to Abe et al. is directed to a cooling strategy for a piezoelectric actuator. In the design proposed by Abe et al., a piezoelectric actuator includes a housing wherein a piezoelectric element is disposed. The piezoelectric element is positioned within an enclosure, having a thermally conductive material in contact with the piezoelectric element. A cooling liquid is circulated through a space surrounding the enclosure, and is stated to absorb heat from the piezoelectric element which is transferred through the thermally conductive material. While the design in Abe et al. may have applicability in certain environments, the fluid connections necessary to supply and drain cooling fluid are relatively complex. Moreover, assembly and proper positioning of the piezoelectric actuator of Abe et al. may be cumbersome in an engine environment.

SUMMARY

In one aspect, an internal combustion engine includes an engine housing having at least one cylinder therein, and a fuel injector having an injector body defining a first fuel inlet and a second fuel inlet, and having a control valve assembly positioned within the injector body. The internal combustion engine further includes an actuator subassembly associated with the control valve assembly, including an actuator and a heat exchange interface. The internal combustion engine further includes a fuel system having a plurality of fuel supply circuit segments, the fuel supply circuit connecting with the first fuel inlet of the fuel injector. The internal combustion engine still further includes a cooling system associated with the actuator subassembly, including a cooling circuit with a plurality of cooling circuit segments including a first cooling circuit segment in common with a first fuel supply circuit segment of the fuel system, a second cooling circuit segment connecting with the second fuel inlet and a third cooling circuit segment defined by the injector body which is configured to pass fuel across the heat exchange interface of the actuator subassembly to exchange heat herewith.

In another aspect, the fuel injector includes an injector body having a nozzle group and defining a first fuel inlet, a second fuel inlet, a nozzle supply passage connecting with the first fuel inlet, and at least one nozzle outlet. The fuel injector further includes an outlet check movable between a first position at which it blocks the at least one nozzle outlet from the nozzle supply passage and a second position at which the at least one nozzle outlet is open to the nozzle supply passage. The fuel injector further includes a control valve assembly coupled with the outlet check and an actuator subassembly configured to actuate the control valve assembly, the actuator subassembly including a fluidly sealed casing coupled with the injector body, a piezoelectric element and a preloading device for the piezoelectric element which are each fluidly sealed within the casing. The actuator subassembly further includes a heat exchange interface, and the injector body further includes a cooling circuit segment configured to pass fuel across the heat exchange interface to exchange heat therewith, the cooling circuit segment comprising an inlet passage connecting with the second fuel inlet of the injector body, and an outlet passage.

In still another aspect, a method of operating a fuel system for an internal combustion engine includes a step of establishing a fluid connection between a first fuel inlet of a fuel injector body and at least one nozzle outlet of the fuel injector body via activating an actuator for a control valve assembly. The method further includes the steps of transferring heat from the actuator to a heat exchange interface of an actuator subassembly which includes the actuator, and cooling the actuator subassembly at least in part via a step of passing fuel across the heat exchange interface by way of a cooling circuit segment connecting with a second fuel inlet of the fuel injector body and a fuel outlet of the fuel injector body.

DETAILED DESCRIPTION

Figure 1:
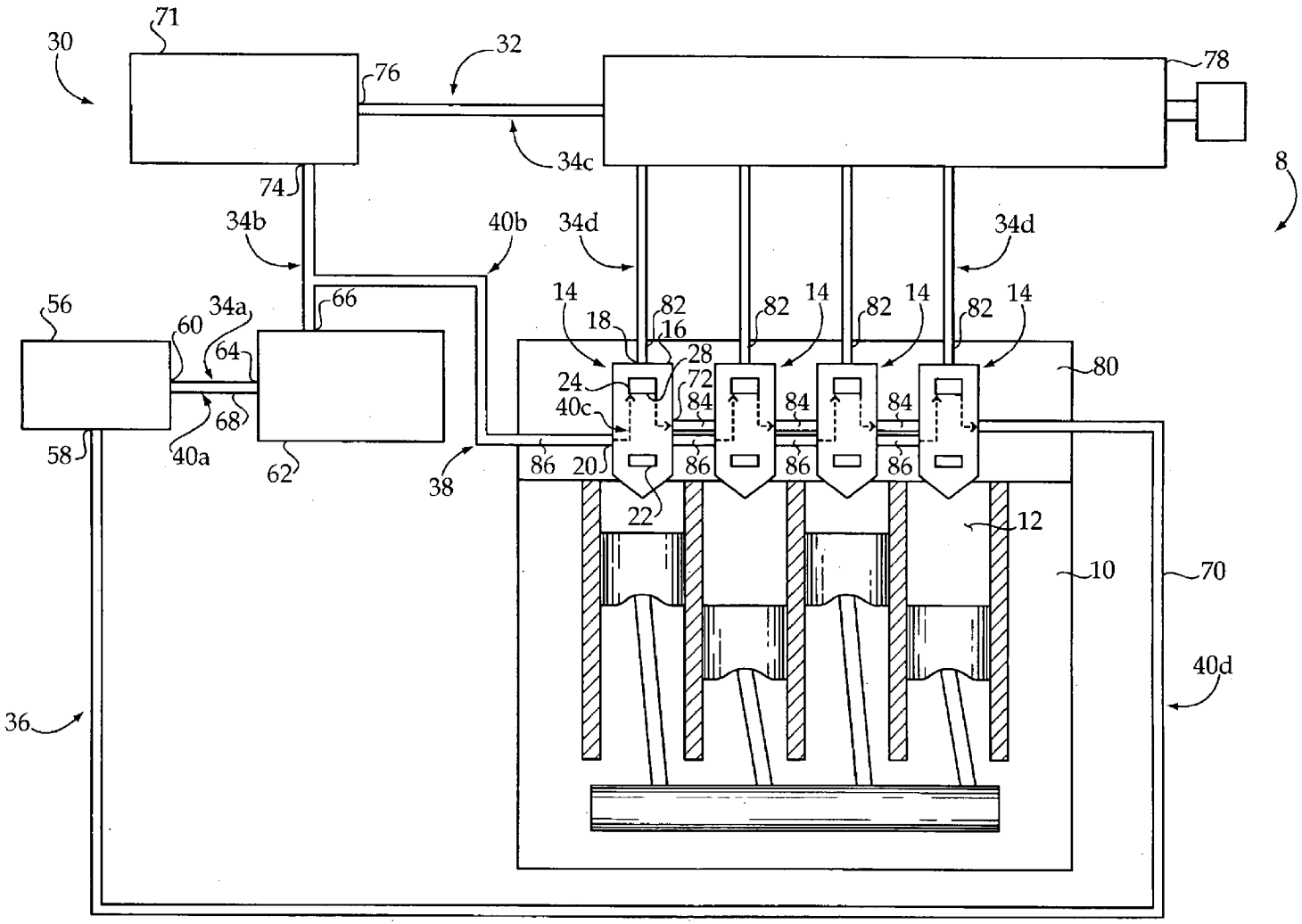
FIG. 1 is a partially sectioned diagrammatic view of an internal combustion engine according to one embodiment.

Referring to FIG. 1, there is shown an engine 8 and associated systems, according to one embodiment. Engine 8 may include an engine housing 10 having one or more cylinders 12 therein. Engine 8 may further include a fuel injector 14 associated with each one of cylinders 12. Fuel injector 14 may include an injector body 16 defining a first fuel inlet 18 and a second fuel inlet 20, and further having a control valve assembly 22 positioned within injector body 16. First fuel inlet 18 may comprise a high pressure inlet, and second fuel inlet 20 may comprise a low pressure inlet. Each fuel injector 14 may further include an actuator subassembly 24 for the corresponding control valve assembly 22, coupled with the corresponding injector body 16. As will be further apparent from the following description, control valve assembly 22 may be controllably coupled with actuator subassembly 24 to control injection of a fuel via the corresponding fuel injector 14 into cylinder 12. In one embodiment, engine 8 may comprise a direct injection compression ignition diesel engine, however, in other embodiments, engine 8 may comprise a spark ignited engine, a port injected engine, or any of a variety of other engine configurations. One practical implementation strategy includes a plurality of cylinders 12 in engine housing 10 and a plurality of fuel injectors 14 each corresponding to one of cylinders 12. Fuel injectors 14 may be identical to one another, and thus references herein to a single one of fuel injectors 14 or a single one of its associated components should be understood to similarly refer to corresponding components and operation of the other fuel injectors 14. As further explained herein, engine 8 includes a cooling strategy for components of fuel injectors 14 whereby heat may be dissipated from the corresponding actuator subassembly 24.

Actuator subassembly 24 may include an electrical actuator (not shown in FIG. 1) which generates heat as it cycles between an activated or energized state and a deactivated or unenergized state, and a heat exchange interface 28. Engine 8 may further include a fuel system 30 which includes a fuel supply circuit 32 having a plurality of segments. In one embodiment, a first segment 34*a* of fuel supply circuit 32 may fluidly connect an outlet 60 of a fuel tank 56 with an inlet 64 of a fuel transfer pump 62. A second segment 34*b* may fluidly connect an outlet 66 of fuel transfer pump 62 with an inlet 74 of a high pressure pump 71. High pressure pump 71 may include an outlet 76 which is fluidly connected with a common rail 78 via a third segment 34*c* of fuel supply circuit 32. Fuel supply circuit 32 may further include a fourth segment 34*d* which fluidly connects common rail 78 with first fuel inlet 18. A plurality of high pressure supply conduits 82, which may be part of fourth segment 34*d*, may extend within an engine head 80 coupled with housing 10 to supply fuel at a high pressure from common rail 78 to each fuel injector 14. Each injector 14 may be mounted in engine head 80.

Engine 8 may further include a cooling system 36 for actuator subassembly 24 which includes a cooling circuit 38 also having a plurality of segments, including a segment in common with a segment of fuel system 30. In one embodiment, cooling circuit 38 includes a first segment 40*a* which is coextensive with first segment 34*a* of fuel supply circuit 32. Cooling circuit 38 may include a second segment 40*b* which connects with second fluid inlet 20, and a third segment 40*c* defined at least in part by injector body 16 which is configured to pass fuel across heat exchange interface 28 to exchange heat therewith. Second segment 40*b* may also extend in engine head 80, and in a multi-cylinder embodiment of engine 8, may include a plurality of low pressure fuel supply conduits 86 which each supply fuel to one of fuel injectors 14 for cooling thereof, as further described herein. Cooling circuit 38 may further include a fourth segment 40*d* which extends from engine head 80 back to an inlet 58 of fuel tank 56. In a multi-cylinder embodiment, fourth segment 40*d* may include a plurality of drain conduits 84 connecting each of fuel injectors 14 with fuel tank 56. Fuel supply circuit 32 and cooling circuit 38 may be fluidly isolated from one another apart from the common segments identified herein. It may be recalled that segment 34*a* of fuel supply circuit 32 and segment 40*a* of cooling circuit 38 may comprise a common segment. Since second segment 40*b* of cooling circuit 38 connects with second segment 34*b* of fuel supply circuit 32, fuel transfer pump 62 might also be considered a common segment. In addition, as further described herein, fuel supplied via fourth segment 34*d* of fuel supply circuit 32 which is not injected, but rather passed to a drain, may be drained into drain conduits 84 and thus supplied to fourth segment 40*d* of cooling circuit 38. Accordingly, fourth segment 40*d* may also be considered a common segment between cooling circuit 38 and fuel supply circuit 32, however, in other embodiments, the common drain strategy might not be used. In any event, each injector body 16 may further include a low pressure fuel outlet 72 which transfers fuel to a drain conduit 70 including fourth segment 40*d*.

Figure 2:
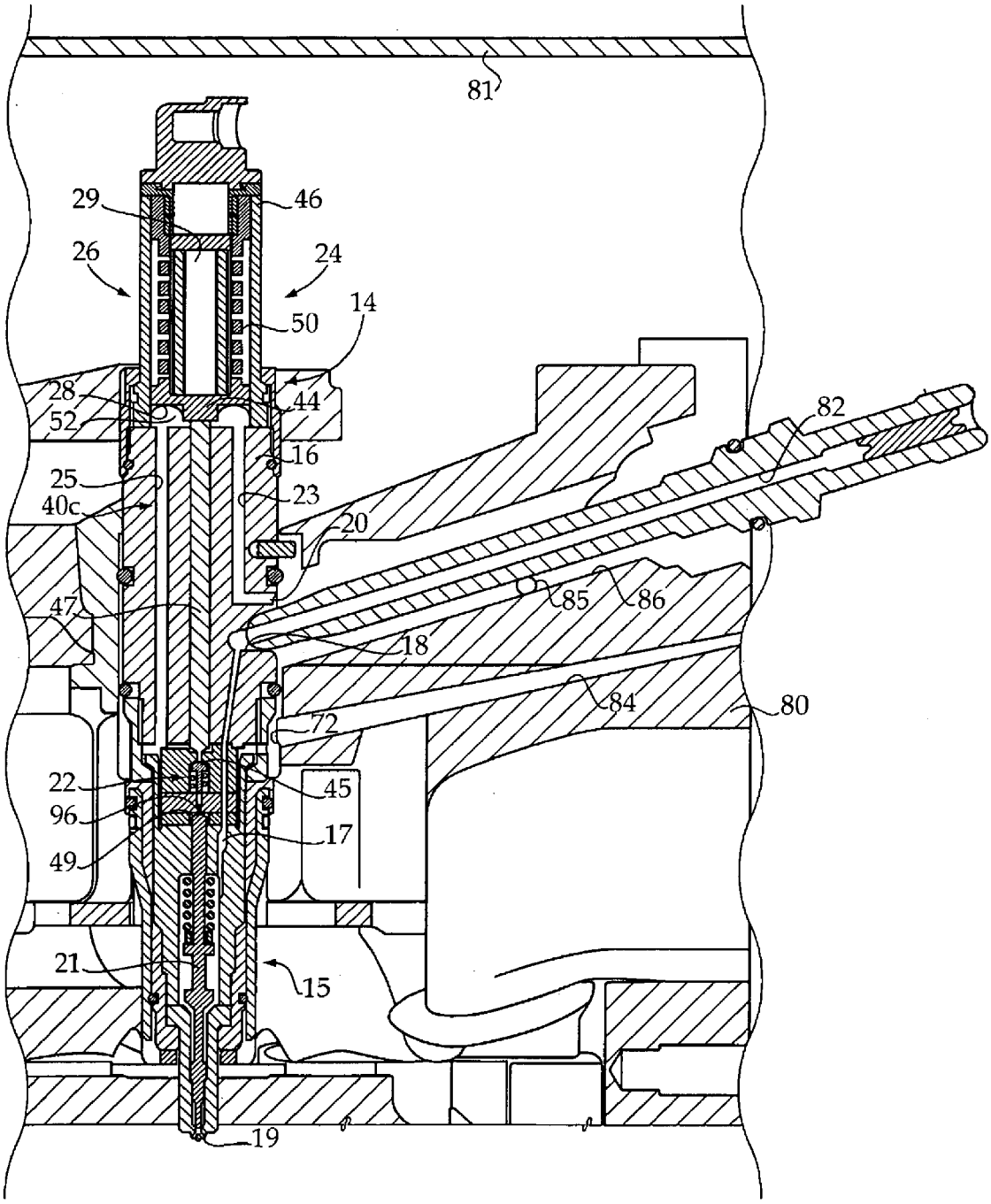
FIG. 2 is a partially sectioned side diagrammatic view of a portion of the engine shown in FIG. 1 and illustrating a fuel injector, according to one embodiment.

Referring now to FIG. 2, there is shown a sectioned side diagrammatic view of fuel injector 14 as it might appear mounted in engine head 80 in one embodiment. Injector body 16 may include a nozzle group 15 which includes at least one nozzle outlet 19 whereby fuel may be injected into a cylinder 12, as shown in FIG. 1. Nozzle group 15 may further have an outlet check 21 positioned therein which includes a control surface 49. A nozzle supply passage 17 may connect first fuel inlet 18 with outlet check 21, such that high pressure fuel supplied to nozzle supply passage via conduit 82 may be injected via outlet 19. Nozzle supply passage 17 may be formed as a high pressure passage. A control passage 96 may be provided which supplies a control pressure to control surface 49. Control valve assembly 22 may include a control valve member 45 which is movable between a first position at which control passage 96 is open to inlet 18 but blocked from outlet 72 and a second position at which control passage 96 is open to outlet 72. Outlet 72 fluidly connects with drain conduit 84, such that control passage 96 may provide a varying fluid pressure to control surface 49, for controlling fuel injection from passage 17.

Actuator subassembly 46 may be controllably coupled with control valve assembly 22 via a rod 47 in one embodiment. Thus, actuation of actuator subassembly 46 can move rod 47 such that a position of control valve member 45 is varied to vary a fluid pressure acting on control surface 49. When a relatively higher pressure is applied to control surface 49, outlet check 21 blocks outlet 19 from nozzle supply passage 17. When a relatively low pressure is applied to control surface 49, such as when control passage 96 is connected to low pressure outlet 72, a pressure of fuel in nozzle supply passage 17 may be sufficient to lift outlet check 21 to open nozzle outlet 19, establishing a fluid connection with inlet 18 for injecting fuel.

Also shown in FIG. 2 are certain of the features of third segment 40*c* of cooling circuit 38. Third segment 40*c* may include an inlet passage 23 defined by injector body 16 which connects with inlet 20. A low pressure inlet 85 may be defined by engine head 80 and may provide a fluid connection from second segment 40*b* (not shown in FIG. 2) to third segment 40*c*, via low pressure fuel supply conduit 86. In one embodiment, high pressure supply conduit 82 may comprise a quill connector positioned in engine head 80, and low pressure fuel supply conduit 86 may comprise a space surrounding the quill connector of high pressure supply conduit 82. Thus, low pressure fuel supplied via cooling circuit 38 may enter engine head 80 via inlet 85, and thenceforth flow to low pressure inlet 20 and into inlet passage 23. High pressure fuel supplied via fuel supply circuit 32 may flow via high pressure supply conduit 82 to inlet 18, and thenceforth to nozzle supply passage 17.

It will be recalled that actuator subassembly 46 may include a heat exchange interface 28. In one embodiment, fuel supplied via inlet passage 23 may be passed across heat exchange interface 28 to exchange heat therewith, and may thenceforth flow to an outlet passage 25 of third segment 40*c*. Outlet passage 25, also defined by injector body 16, may fluidly connect with low pressure outlet 72 such that fuel may be circulated through injector body 16 to cool actuator subassembly 46, and then drain into drain conduit 84 from outlet 72. In the FIG. 2 illustration, inlet passage 23 and outlet passage 25 are shown off-plane. In other words, inlet passage 23 and outlet passage 25 are shown in a different plane than that which they will typically occupy in a practical implementation strategy. Thus, while inlet passage 23 and outlet passage 25, respectively, are illustrated in FIG. 2 as if they occupy the same plane as nozzle supply passage 17, this will typically not be the case. Depending upon the injector configuration in which the present disclosure is implemented, a variety of different plumbing strategies might be used and could include embodiments where the respective passages 23, 25, 17 lie in a common plane. Thus, the present disclosure should be understood as not limited to any particular plumbing strategy, apart from injector body 16 having the described passages 23, 25, etc.

Figure 3:
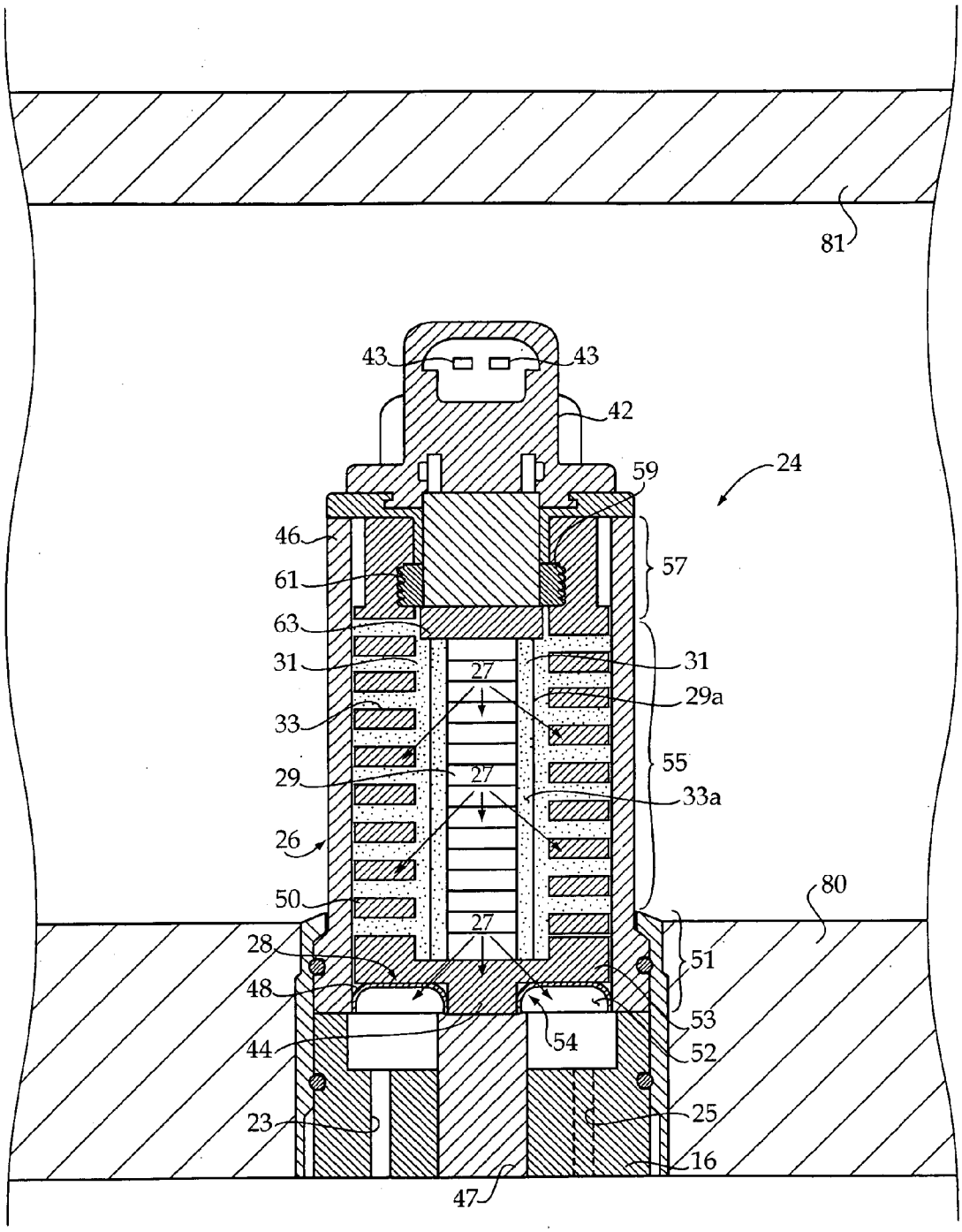
FIG. 3 is a sectioned side diagrammatic view of a portion of the fuel injector shown in FIG. 2, taken in a different section plane.

Referring also to FIG. 3, there is shown a sectioned side diagrammatic view of a portion of injector 14, shown in a different section plane as compared to the view shown in FIG. 2. In particular, FIG. 3 includes a close-up view of actuator subassembly 24. It may be recalled that actuator subassembly 24 may be configured to actuate control valve assembly 22. To this end, actuator subassembly 24 may include a contact element 44 which is configured to contact rod 47 for controlling a position of valve member 45. In one embodiment, actuator subassembly 24 may comprise a piezoelectric actuator 26 having a piezoelectric element 29 fluidly sealed within a casing 46 and configured to connect with an electrical system (not shown) of an associated engine system via a pair of electrical connectors 43. Electrical connectors 43 may be accessible in an exposed position in a cap 42 of actuator subassembly 24. Casing 46 may be coupled with and fluidly sealed with injector body 16, and may include a plurality of internal components fluidly sealed within casing 46, and fluidly isolated from other components of fuel injector 14 in one embodiment. Piezoelectric actuator 26 may include a piezoelectric element or stack 29 such as a stack of piezoelectric disks, and a thermal compensation material 31 which is in thermal contact with piezoelectric element 29. Piezoelectric element 29 may be positioned at least partially within a preloading spring 50 which is also fluidly sealed within casing 46. Preloading spring 50 may exert a preloading force, such as a compressive force, on piezoelectric element 29 to enable desired operation, in a manner which will be familiar to those skilled in the art.

In one embodiment, spring 50 may be part of a multi-function spring assembly having a first segment 51 which comprises a piston 53 having contact element 44 thereon, a second segment 55 which comprises an elastically deformed segment exerting the preloading force on piezoelectric element 29 and including spring 50, and a third segment 57. In one embodiment, third segment 57 may be configured for setting and/or adjusting a preload on piezoelectric element 29. To this end, third segment 57 may include a set of threads 59 which are configured to receive a threaded locking element 61 such as an externally threaded nut. Threadedly engaging locking element 61 with third segment 57 can expand or contract second segment 55 to vary an effective preloading force applied to piezoelectric element 29 via spring 50. The configuration and use of locking element 61, as well as the multi-function spring or spring assembly of which spring 50 is a part is more fully explained in commonly owned U.S. patent application Ser. No. 11/998,642. A preload control element 63, for example a thermally expansive material such as aluminum, may be disposed between piezoelectric element 29 and locking element 61 or other components such as spacers, etc. Preload control element 63 may expand or contract in response to temperature changes to maintain or control a preload applied to piezoelectric element 29 via preloading spring 50. Preloading spring 50 may be coupled with casing 46 via a flexible diaphragm 48 which moves when piezoelectric actuator 26 is activated and deactivated to control a position of rod 47 and in turn control fuel injection with fuel injector 14, as described herein. In certain embodiments, a sealing element other than a flexible diaphragm, such as an O-ring, might be used. In one embodiment, actuator subassembly 24 and injector body 16 may together define an annular cavity 52 which surrounds contact element 44 and adjoins diaphragm 48. Diaphragm 48 may include an outer surface 54 which is exposed to cavity 52. Heat exchange interface 28 may include outer surface 54. It will be noted in the FIG. 3 illustration that inlet passage 23 connects with cavity 52, as does outlet passage 25. Thus, cooling fuel may be circulated through cavity 52 and across heat exchange interface 28 to exchange heat therewith.

Actuator subassembly 24 may further define a thermal transfer pathway from piezoelectric element 29 to heat exchange interface 28. It may be recalled that thermal compensation material 31 may surround piezoelectric element 29 and be in thermal contact therewith. Thermal compensation material 31 may be formed as a thermal transfer material such as thermally conductive silicon oil, including any of a variety of proprietary and/or commercially available materials. Second segment 55 of spring 50, may have a helical configuration. A cavity 33 may be defined in part by spring 50 and also in part by casing 46. In one embodiment, thermal compensation material 31 may be positioned within cavity 33. In one further embodiment, thermal compensation material 31 may also be positioned in a cavity 33*a* which surrounds piezoelectric element 29 and is defined in part by piezoelectric element 29. Cavity 33 may be fluidly separated from cavity 33*a* via a barrier 29*a*. Barrier 29*a* may be a housing for piezoelectric element 29*a*. Each cavity 33 and 33*a* may be filled or substantially filled with thermal compensation material 31, for example by injecting thermal compensation material 31 therein. In embodiments where each cavity 33 and 33*a* is filled with thermal compensation material 31, actuator subassembly 24 may be at least substantially free of air, improving thermal transfer between components thereof. Thermal transfer pathway 27 may extend from piezoelectric element 29 to heat exchange interface 28, and may include thermal compensation material 31, and may also include portions of spring 50. In other words, spring 50 or other components of the multi-function spring of which spring 50 is a part, such as piston 53, may be disposed in thermal transfer pathway 27, and may thus serve to conduct heat from piezoelectric element 29 to heat exchange interface 28, and thenceforth to cooling fuel in cavity 52. Thermal compensation material 31 will typically be in thermal contact with both spring 50 and piezoelectric element 29, and at least a portion of thermal compensation material 31 will typically be between spring 50 and piezoelectric element 29.

It may further be noted that a portion of casing 46 extends from engine head 80. In other words, in one embodiment, actuator subassembly 24 may be positioned such that it extends upwardly from engine head 80 when mounted therein. This allows at least a portion of casing 46, for example 40% or more of an exterior of casing 46, to be exposed to a space defined by engine head 80 and a valve cover 81. This can enhance the cooling efficacy, as casing 46 may radiate heat into the space defined by valve cover 81 and engine head 80, and oil splash on casing 46 may also conduct heat therefrom.

Figure 4:
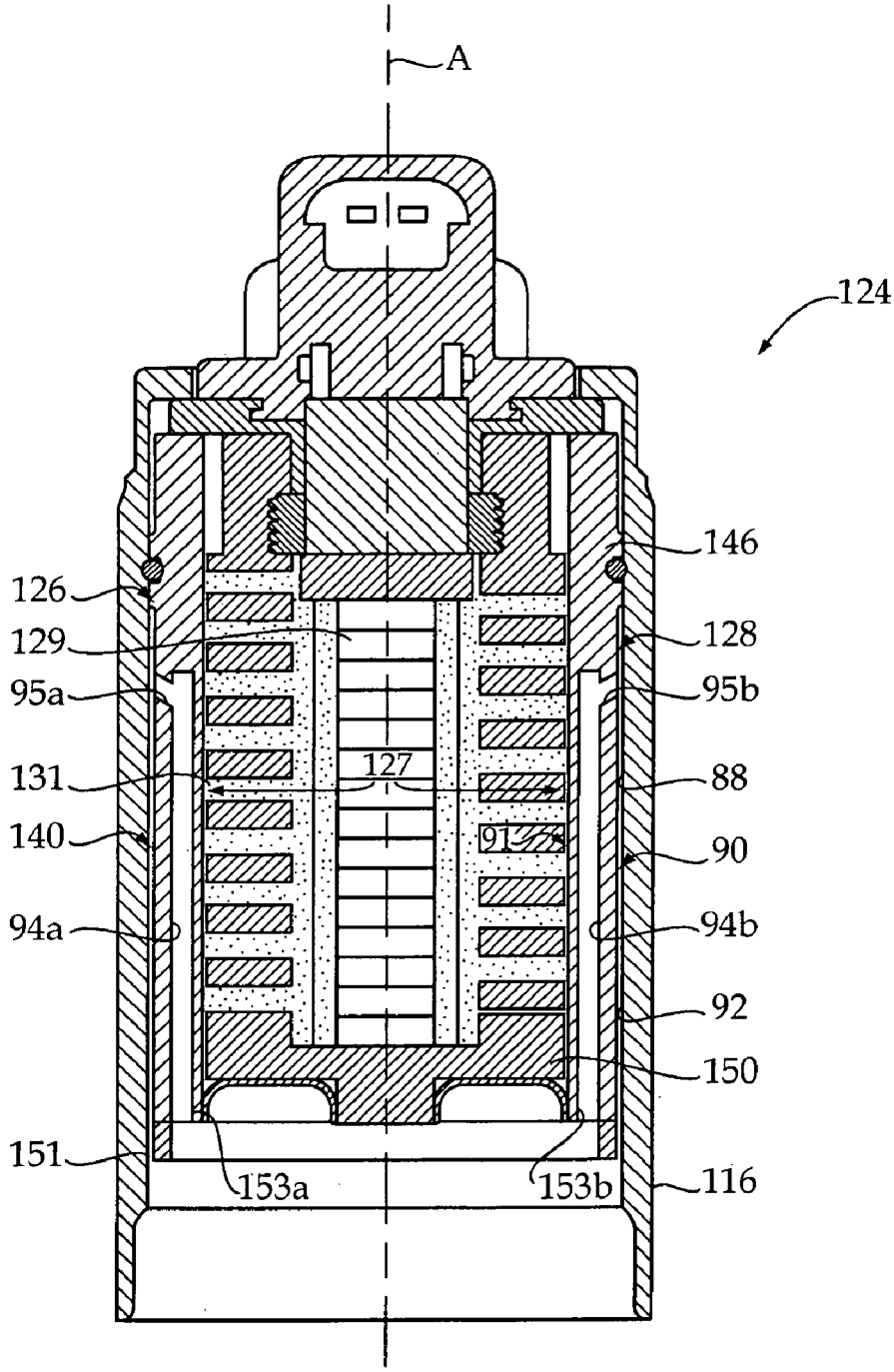
FIG. 4 is a sectioned side diagrammatic view of a portion of a fuel injector, according to another embodiment.

Turning now to FIG. 4, there is shown an actuator subassembly 124 according to another embodiment. Certain of the features of actuator subassembly 124 may be similar to or identical to features shown and described in connection with actuator subassembly 24, and are therefore not specifically described herein. Actuator subassembly 124 may include a casing 146 having an electrical actuator 126 therein. Actuator subassembly 124 may, similar to actuator subassembly 24, include a piezoelectric element or stack 129, including for example a stack of piezoelectric disks. Actuator subassembly 124 may further define a thermal transfer pathway 127 from piezoelectric element 129 to a heat exchange interface 128. Cooling of actuator subassembly 124 may take place in a manner similar to that of actuator subassembly 24, but with certain differences. Rather than passing cooling fuel across a diaphragm, cooling fuel is passed via an inlet 151 to a cavity 92 which is defined by an outer diameter 90 of casing 146 and an inner diameter 88 of injector body 116. From cavity 92 cooling fuel may pass into at least one longitudinal passage 94*a*, 94*b* via an inlet 95*a*, 95*b* defined by casing 146. As shown in FIG. 4, a first and second longitudinal passage 94*a* and 94*b* may be positioned parallel a longitudinal axis A of actuator subassembly 124 and may be disposed between outer diameter 90 and an inner diameter 91 of casing 146. The term longitudinal, however, should not be taken to mean that passages 94*a* and 94*b* must be exactly parallel with axis A. Since casing 146 will typically be formed as a cylinder, however, forming passages 94*a* and 94*b* parallel to axis A may be a practical implementation strategy. Fluid passing through passages 94*a* and 94*b* may exit via a first outlet 153*a* and a second outlet 153*b*, and may thenceforth be drained to a fuel tank, in a manner similar to that described with regard to actuator subassembly 24. Cavity 92 and passages 94*a* and 94*b* may be part of a cooling circuit segment 140 of a cooling system similar to that shown in FIG. 1. Heat exchange interface 128 may comprise outer diameter 90 of casing 146, such that heat is transferred from piezoelectric element 129 to a thermal compensation material 131 and thenceforth from inner diameter 91 to outer diameter 90 and to cooling fuel in cavity 92. Passing fuel through passages 94*a* and 94*b* in casing 146 may further enhance thermal transfer efficacy, while providing for an efficient packaging strategy.

INDUSTRIAL APPLICABILITY

Referring to FIGS. 1-3, operation of engine 8 may in many respects take place in a manner familiar to those skilled in the art. When engine 8 is started, fuel transfer pump 62 may receive fuel from fuel tank 56, and subsequently supply fuel at a relatively low pressure to high pressure pump 71, and also to cooling circuit 38. High pressure pump 71 will typically elevate a fuel pressure to a relatively high pressure, and supply relatively high pressure fuel to common rail 78. Each of fuel injectors 14 is connected with common rail 78 and may receive high pressure fuel therefrom in a conventional manner. Actuator subassemblies 24 may be used to selectively open nozzle outlets of the corresponding fuel injectors 14 to inject fuel into the corresponding cylinders 12. As described above, operation of actuators 26 associated with each actuator subassembly 24 may generate heat. Cooling circuit 38 supplies fuel at a relatively low pressure to each of fuel injectors 14, which serves to cool each actuator subassembly 24 by passing the fuel across the corresponding heat exchange interface 28, then returning the fuel to fuel tank 56. Operation and cooling of actuator subassembly 124 may take place in a generally analogous manner, albeit via the different plumbing and different component configurations thereof.

As alluded to above, common strategies for cooling piezoelectric actuators in particular tend to be relatively ineffective, or unwieldy. By implementing the teachings of the present disclosure, actuator subassemblies 24, 124 may be installed in an engine such as engine 8 relatively easily. Since fuel injectors 14 may be purpose built with internal cooling circuit segment 40*c*, once actuator subassembly 24, 124 is coupled therewith, no additional fluid connections need be made between components of actuator subassembly 24, 124 and/or fuel injector 14. Whereas earlier strategies such as Abe et al., described above, relied upon establishing fluid connections under a valve cover once an actuator or fuel injector was mounted in an engine, assembled fuel injectors according to the present disclosure can be installed in engine head 80 and successfully operate as well as be cooled without further assembly or connecting steps.

The present description is for illustrative purposes only, and should not be construed to narrow the breadth of the present disclosure in any way. Thus, those skilled in the art appreciate that various modifications might be made to the presently disclosed embodiments without departing from the full and fair scope of the present disclosure. For example, while the present description focuses primarily on cooling piezoelectric actuators, it is not limited thereto. In other embodiments, solenoid actuators, or other electrical or even mechanical actuators could be successfully cooled according to the teachings of the present disclosure. Moreover, while common rail systems will often be used in engines contemplated herein, the present disclosure is also not limited in this regard. Unit pumps associated with each of a plurality of fuel injectors, such as cam actuated pumps, might also be used, and the presently described cooling strategy used to cool electrical actuators associated with the cam actuated fuel injectors. Other aspects and features will be apparent upon an examination of the attached drawings and appended claims.

What is claimed is:

1. An internal combustion engine comprising:

an engine housing having at least one cylinder therein;

a fuel injector having an injector body defining a first fuel inlet and a second fuel inlet, and having a control valve assembly positioned within the injector body;

an actuator subassembly associated with the control valve assembly, including an actuator and a heat exchange interface;

a fuel system which includes a fuel supply circuit having a plurality of fuel supply circuit segments, the fuel supply circuit connecting with the first fuel inlet of the fuel injector; and a cooling system associated with the actuator subassembly including a cooling circuit with a plurality of cooling circuit segments, including a first cooling circuit segment in common with a first fuel supply circuit segment of the fuel system, a second cooling circuit segment connecting with the second fuel inlet, and a third cooling circuit segment defined by the injector body which is configured to pass fuel across the heat exchange interface of the actuator subassembly to exchange heat therewith.

2. The internal combustion engine of claim 1 wherein the actuator subassembly includes a piezoelectric actuator and a contact element configured to adjust the control valve assembly by way of selective activation of the piezoelectric actuator.

3. The internal combustion engine of claim 2 wherein the actuator subassembly includes a casing coupled with the injector body and a preloading spring, the piezoelectric actuator and the preloading spring being fluidly sealed within the casing.

4. The internal combustion engine of claim 3 wherein the third cooling circuit segment includes a fluid cavity defined by the actuator subassembly and the injector body, wherein the actuator subassembly includes a flexible diaphragm having an outer surface exposed to the fluid cavity and wherein the heat exchange interface includes the outer surface.

5. The internal combustion engine of claim 3 wherein:

the third cooling circuit segment includes a fluid cavity defined by an outer diameter of the casing and the injector body, and at least one fluid passage extending in the casing and disposed between the outer diameter and an inner diameter of the casing; and the heat exchange interface includes the outer diameter of the casing.

6. The internal combustion engine of claim 2 further comprising:

a fuel tank having a fuel tank inlet and a fuel tank outlet, a fuel transfer pump having a fuel transfer pump inlet and a fuel transfer pump outlet, and a fuel supply conduit fluidly connecting the fuel tank outlet with the fuel transfer pump inlet, wherein the first cooling circuit segment includes the fuel supply conduit; and a drain conduit, the injector body defining a low pressure fuel outlet and the drain conduit fluidly connecting the low pressure fuel outlet with the fuel tank, and wherein the fuel supply circuit and the cooling circuit each fluidly connect with the low pressure fuel outlet, the drain conduit including a fourth cooling circuit segment common with a second fuel supply circuit segment.

7. The internal combustion engine of claim 6 wherein:

the engine housing includes a plurality of cylinders, the fuel injector being a first injector; and the internal combustion engine further includes a plurality of fuel injectors identical to the first injector and each extending into one of the plurality of cylinders, a high pressure pump having a high pressure pump inlet fluidly connected with the fuel transfer pump outlet and a high pressure pump outlet fluidly connected with a common rail configured to supply high pressure fuel to each one of the plurality of fuel injectors.

8. The internal combustion engine of claim 7 further comprising:

an engine head in which each of the plurality of fuel injectors is mounted, the engine head including therein a plurality of high pressure supply conduits each fluidly connecting the common rail with the first fuel inlet of one of the fuel injectors;

a plurality of drain conduits each fluidly connecting the low pressure fuel outlet of one of the fuel injectors with the inlet of the fuel tank; and a plurality of low pressure supply conduits each fluidly connecting the fuel transfer pump outlet with the second fuel inlet of one of the fuel injectors.

9. A fuel injector comprising:

an injector body which includes a nozzle group and defines a first fuel inlet, a second fuel inlet, a nozzle supply passage connecting with the first fuel inlet, and at least one nozzle outlet;

an outlet check movable between a first position at which it blocks the at least one nozzle outlet from the nozzle supply passage and a second position at which the at least one nozzle outlet is open to the nozzle supply passage;

a control valve assembly coupled with the outlet check; and an actuator subassembly configured to actuate the control valve assembly, the actuator subassembly including a fluidly sealed casing coupled with the injector body, a piezoelectric element and a preloading device for the piezoelectric element which are each fluidly sealed within the casing, and the actuator subassembly further including a heat exchange interface;

wherein the injector body further includes a cooling circuit segment configured to pass fuel across the heat exchange interface to exchange heat therewith, the cooling circuit segment comprising an inlet passage connecting with the second fuel inlet of the injector body, and an outlet passage.

10. The fuel injector of claim 9 wherein the actuator subassembly defines a thermal conduction pathway from the piezoelectric element to the heat exchange interface.

11. The fuel injector of claim 10 wherein the actuator subassembly includes a first cavity defined in part by the piezoelectric element and surrounding the piezoelectric element, and a second cavity surrounding the first cavity and defined in part by a barrier which fluidly separates the first cavity from the second cavity and in part by the casing, the actuator subassembly further including a thermal compensation material disposed in each of the first and second cavities.

12. The fuel injector of claim 10 wherein the actuator subassembly further includes a piston having a contact element contacting the control valve assembly and movable by way of selective activation of the piezoelectric element, and a sealing element fluidly sealing between the casing and the piston which is coupled to move with the contact element.

13. The fuel injector of claim 12 further including a multi-function spring which includes the preloading device, the multi-function spring having a first segment which includes the piston, a second segment including an elastically deformed segment exerting a preloading force on the piezoelectric element and a third segment including threads.

14. The fuel injector of claim 12 wherein the cooling circuit segment further includes a cavity defined by the actuator subassembly and the injector body, the cavity including an annular cavity extending about the contact element of the actuator subassembly, wherein the sealing element includes a flexible diaphragm having an outer surface exposed to the cavity and the heat exchange interface includes the outer surface.

15. The fuel injector of claim 12 wherein the casing includes a longitudinal axis, an inner diameter and an outer diameter, the cooling circuit segment including a cavity defined by the outer diameter of the casing and by the injector body, and at least one longitudinal passage extending within the casing and located between the inner diameter and the outer diameter, the at least one longitudinal passage fluidly connecting with the cavity and with one of the inlet passage and the outlet passage of the cooling circuit segment.

16. The fuel injector of claim 10 wherein:

the nozzle supply passage comprises a high pressure passage, the injector body further defining a control passage and a low pressure fuel outlet, the control passage being selectively connectable with the low pressure fuel outlet by actuating the control valve assembly; and the outlet passage of the cooling circuit segment is fluidly connected with the low pressure fuel outlet.

17. A method of operating a fuel system for an internal combustion engine comprising the steps of:

establishing a fluid connection between a first fuel inlet of a fuel injector body and at least one nozzle outlet of the fuel injector body via activating an actuator for a control valve assembly;

transferring heat from the actuator to a heat exchange interface of an actuator subassembly which includes the actuator; and cooling the actuator subassembly at least in part via passing fuel across the heat exchange interface by way of a cooling circuit segment connecting with a second fuel inlet of the fuel injector body and a fuel outlet of the fuel injector body.

18. The method of claim 17 wherein the step of activating the actuator includes energizing a piezoelectric element, and wherein the step of transferring heat from the actuator includes transferring heat by way of a thermal conduction pathway which includes a preloading device for the piezoelectric element.

19. The method of claim 18 further comprising the steps of:

supplying high pressure fuel to a high pressure passage of the fuel injector body via the first fuel inlet;

supplying low pressure fuel to the cooling circuit segment via the second fuel inlet;

draining fuel from the high pressure passage to a low pressure drain conduit via the fuel outlet during the step of establishing the fluid connection; and draining fuel from the cooling circuit segment to the low pressure drain conduit via the fuel outlet during the step of cooling the actuator subassembly.

* * * * *